US007744250B2

(12) United States Patent
Lee et al.

(10) Patent No.: US 7,744,250 B2
(45) Date of Patent: Jun. 29, 2010

(54) LED LAMP WITH A HEAT DISSIPATION DEVICE

(75) Inventors: Tsung-Lung Lee, Taipei Hsien (TW); Wen-Xiang Zhang, Shenzhen (CN); Shi-Song Zheng, Shenzhen (CN); Xu-Hua Xiao, Shenzhen (CN); Yi-San Liu, Shenzhen (CN); Guang Yu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 149 days.

(21) Appl. No.: 11/776,896

(22) Filed: Jul. 12, 2007

(65) Prior Publication Data

US 2009/0016072 A1 Jan. 15, 2009

(51) Int. Cl.
*F21V 29/00* (2006.01)

(52) U.S. Cl. ..... 362/294; 362/373; 362/249.02

(58) Field of Classification Search ..... 362/294, 362/373, 249, 800, 249.02; 257/88
See application file for complete search history.

(56) References Cited

U.S. PATENT DOCUMENTS

| | | | | |
|---|---|---|---|---|
| 6,573,536 | B1 | 6/2003 | Dry | |
| 6,831,303 | B2 * | 12/2004 | Dry | 257/88 |
| 6,955,451 | B2 * | 10/2005 | Coushaine et al. | 362/294 |
| 6,991,351 | B1 * | 1/2006 | Petrick | 362/373 |
| 7,079,041 | B2 | 7/2006 | Fredericks et al. | |
| 7,261,730 | B2 * | 8/2007 | Friedman et al. | 607/92 |
| 7,401,945 | B2 * | 7/2008 | Zhang | 362/249 |
| 2007/0230184 | A1 * | 10/2007 | Shuy | 362/294 |
| 2008/0130299 | A1 * | 6/2008 | Dorogi | 362/373 |
| 2008/0150126 | A1 * | 6/2008 | Zhou et al. | 257/712 |

FOREIGN PATENT DOCUMENTS

| | | | |
|---|---|---|---|
| CN | 1656622 | A | 8/2005 |
| CN | 2851822 | A | 12/2006 |

* cited by examiner

*Primary Examiner*—Stephen F. Husar
*Assistant Examiner*—Peggy A. Neils
(74) *Attorney, Agent, or Firm*—Jeffrey T. Knapp

(57) ABSTRACT

An LED lamp includes a heat sink (10), a plurality of heat pipes (20) mounted on outer sidewalls (120) of the heat sink, and a plurality of LED modules (30) attached on the outer sidewalls of the heat sink with a portion of each LED module contacting a corresponding heat pipe directly. A plurality of fins (14) extend inwardly from an inner wall of the heat sink in a manner such that a through hole (16) is enclosed by the fins, thereby providing an airflow passage axially through the heat sink. By the use of the heat pipes, heat generated by the LED modules can be transferred to the heat sink evenly, whereby the heat can be dispersed to ambient air efficiently and rapidly.

17 Claims, 3 Drawing Sheets

LED LAMP WITH A HEAT DISSIPATION DEVICE

BACKGROUND OF THE INVENTION

1. Field of the Invention

The present invention relates to a light emitting diode (LED) lamp, and more particularly to an LED lamp incorporating heat pipes for improving heat dissipation of the LED lamp.

2. Description of Related Art

As an energy-efficient light, an LED lamp has a trend of substituting for the fluorescent lamp for indoor lighting purpose; in order to increase the overall lighting brightness, a plurality of LEDs are often incorporated into a signal lamp, in which how to efficiently dissipate heat generated by LEDs becomes a challenge.

Conventionally, an LED lamp comprises a cylindrical enclosure functioning as a heat sink and a plurality of LEDs mounted on an outer wall of the enclosure. The LEDs are arranged in a plurality of lines along a height direction of the enclosure and around the enclosure. The enclosure defines a central through hole oriented along the height direction thereof. When the LEDs are activated to lighten, heat generated by the LEDs is dispersed to ambient air via the enclosure by natural air convection.

However, in order to achieve a higher lighting intensity, the LEDs are crowded next to each other, whereby the heat generated by the LEDs is concentrated at discrete spots, which leads to an uneven heat distribution over the enclosure. The conventional enclosure in not able to dissipate locally-concentrated and unevenly-distributed heat timely and efficiently, whereby a heat accumulation occurs in the enclosure easily. Such heat accumulation may cause the LEDs to overheat and to have an unstable operation or even a malfunction.

What is needed, therefore, is an LED lamp which can overcome the above-mentioned disadvantages.

SUMMARY OF THE INVENTION

An LED lamp includes a heat sink, a plurality of heat pipes mounted on outer sidewalls of the heat sink, and a plurality of LED modules attached on the outer sidewalls of the heat sink with a portion of each LED module contacting a corresponding heat pipe directly. A plurality of fins extends inwardly from an inner wall of the heat sink in a manner such that a through hole is enclosed by the fins, thereby providing passages of airflow therethrough. By the use of the heat pipes, heat generated by the LEDs of the LED modules can be transferred to the heat sink evenly, whereby the heat can be dispersed to ambient air efficiently and rapidly.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
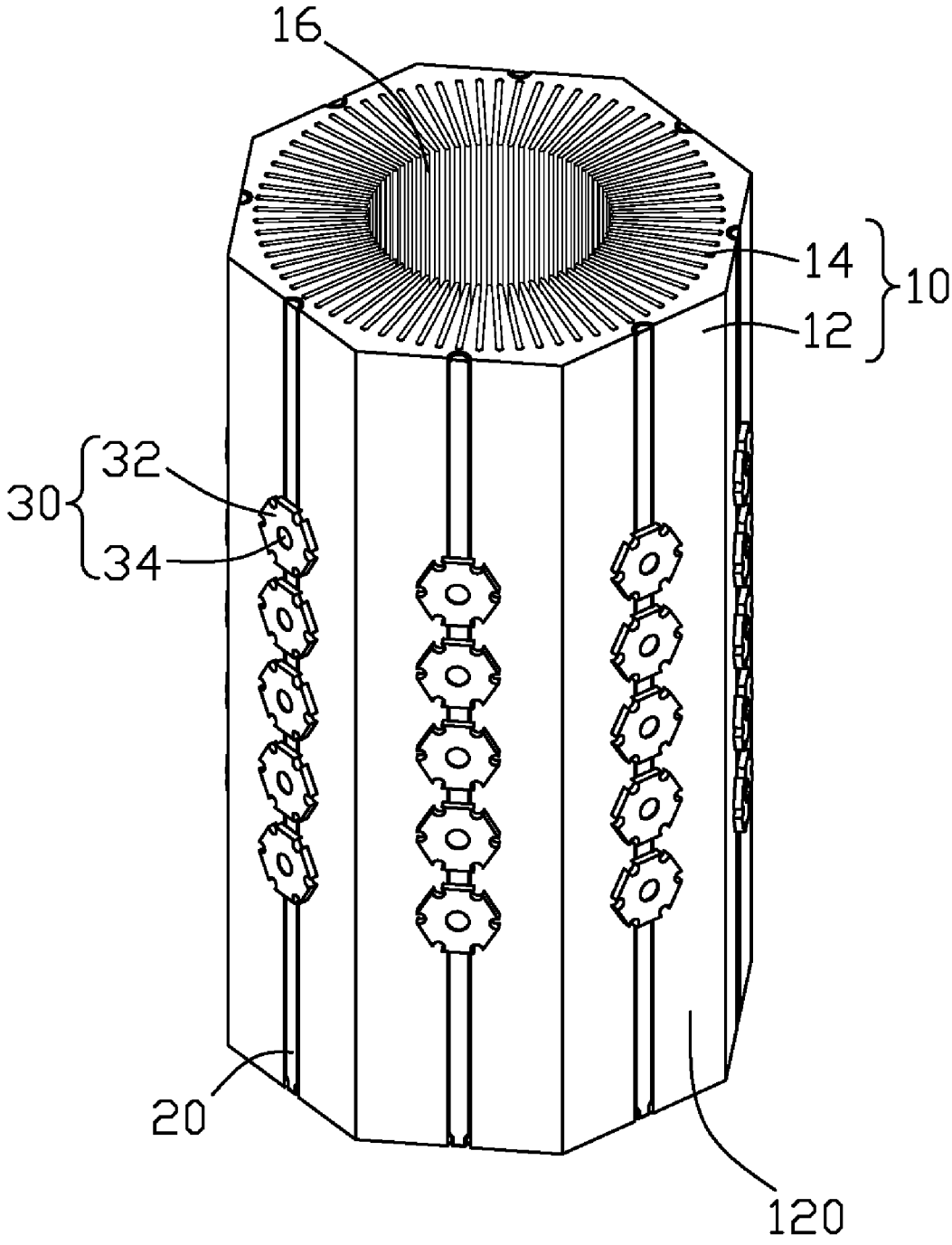
FIG. 1 is an assembled, isometric view of an LED lamp with a heat dissipation device in accordance with a preferred embodiment of the present invention.

Referring to FIG. 1, an LED lamp comprises a heat sink 10, a plurality of heat pipes 20 attached to a periphery of the heat sink 10, and a plurality of LED modules 30 mounted on the periphery of the heat sink 10 and contacting the heat pipes 20 directly.

Figure 2:
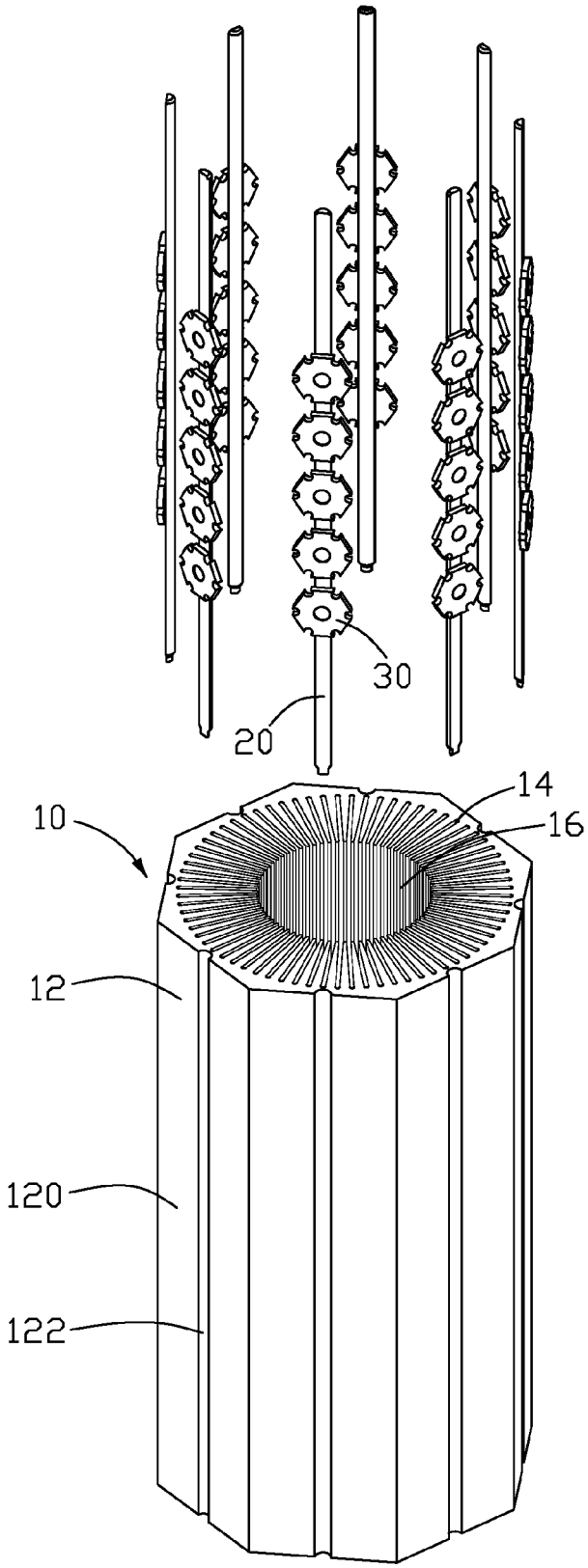
FIG. 2 is an exploded view of FIG. 1.

Referring to FIG. 2, the heat sink 10 is made of metal such as aluminum, copper or an alloy of the two. The heat sink 10 comprises a hollow octagonal prism 12, which has eight rectangular and identical outer sidewalls 120 and a cylindrical inner wall (not labeled). A plurality of identical fins 14 is formed inwardly on the inner wall of the octagonal prism 12 from a bottom to a top of the heat sink 10. The fins 14 are spaced evenly from each other and each has an inward decreasing thickness for providing a plurality of evenly spaced gaps therebetween, by which an airflow can flow through the fins 14. Inner side edges of the fins 14 cooperatively enclose a circular through hole 16 in a central area of the heat sink 10 along an axis of the octagonal prism 12, wherein the through hole 16 communicates with the gaps between the fins 14 of the heat sink 10. A straight groove 122 having a semi circular cross section is defined at a centre of each sidewall 120 along the axis of the octagonal prism 12 and from the top to the bottom of the heat sink 10.

Referring to FIG. 1 again, the heat pipes 20 are straight and accommodated in the grooves 122 of the heat sink 10, respectively. The heat pipes 20 are parallel to each other and each heat pipe 20 has an arced surface being conformably received in a corresponding groove 122, and a planar surface being coplanar with a corresponding sidewall 120 of the heat sink 10.

Each LED module 30 comprises printed circuit board 32 having a shape like a flower disc, and an LED 34 mounted on a front side of a centre of the printed circuit board 32. Five LED modules 30 are arranged in thermally conductive relationship on the sidewall 120 of the heat sink 10 along the axis of the octagonal prism 12. The LED modules 30 located at a common sidewall 120 of the heat sink 10 are positioned adjacent to each other at a central area of the sidewall 120. Each LED module 30 has a central portion directly contacting the planar surface of the heat pipe 20 with the LED 34 of the LED module 30 located above the heat pipe 20, and two lateral portions attached to the sidewall 120 of the heat sink 10 and symmetrically located at two sides of the heat pipe 20.

Figure 3:
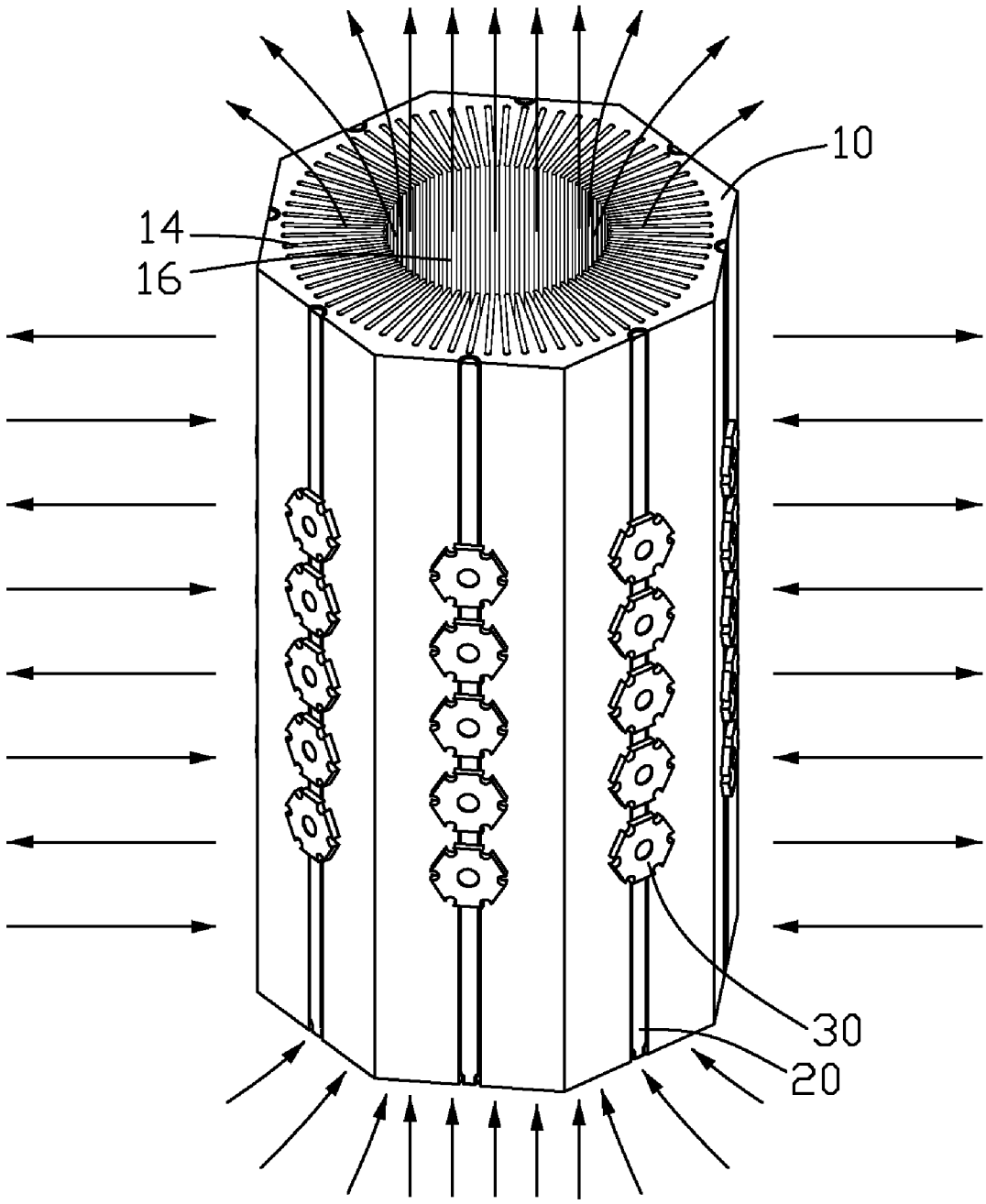
FIG. 3 is a view similar to FIG. 1 with an airflow flowing direction of through the LED lamp of FIG. 1.

As shown in FIGS. 1-3, in use, when the LEDs 34 are activated to lighten, heat generated from the LEDs 34 is conducted to a central portion of the heat sink 10 via the printed circuit board 32. Due to the heat pipes 20 contacting the LED modules 30 directly, the heat can be distributed over the heat sink 10 evenly and rapidly without heat accumulation locally—concentrated and unevenly—distributed on the heat sink 10; thus, the heat can be timely and efficiently dissipated from the heat sink 10 by the cool air flowing through the heat sink 10. A part of the heat is dispersed to the ambient cool air via the sidewalls 120 of the heat sink 10. Remaining heat is conveyed to the cool air through the through hole 16 of the heat sink 10 via the inner wall and the fins 14 of the heat sink 10. The cool air absorbs the heat and is heated. As hot air has a less density than that of the cool air, the hot air flows upwardly away from the heat sink 10 through an upper portion of the through hole 16 and the gaps between the fins 14 of the heat sink 10, and the cool air flows into the heat sink 10 through a lower portion of the through hole 16 and the gaps between the fins 14 of the heat sink 10 to substitute the hot air in a natural convection manner. Then the cool air absorbs the heat from the fins 14 and the inner wall of the heat sink 10 to be converted into the hot air again, thus circulating the air convection continuously. The LED lamp has an improved heat dissipating capability for preventing the LEDs 34 from overheating.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a hollow prism-shaped heat sink with a plurality of fins extending inwardly from an inner wall thereof and a plurality of outer sidewalls;

a plurality of heat pipes mounted on the outer sidewalls of the heat sink respectively; and a plurality of LED modules being attached to the heat sink, each of the LED modules comprising a printed circuit board and an LED mounted on the printed circuit board, the LED modules contacting corresponding heat pipes directly and being secured on corresponding outer sidewalls of the heat sink, wherein when the LED modules are activated, heat generated by the LEDs of the LED modules is transferred to the heat sink evenly and rapidly via the heat pipes.

2. The LED lamp of claim 1, wherein the plurality of the outer sidewalls of the heat sink has a number of 8.

3. The LED lamp of claim 1, wherein a groove is defined in each of the outer sidewalls of the heat sink for receiving a corresponding heat pipe therein.

4. The LED lamp of claim 3, wherein the grooves of the outer sidewalls extend from a top to a bottom along an axis of the heat sink.

5. The LED lamp of claim 3, wherein the corresponding heat pipe has a curved inner surface conformably received in the groove, and a planar outer surface being coplanar with each of the outer sidewalls of the heat sink.

6. The LED lamp of claim 5, wherein each of the LED modules has a central portion contacting the planar surface of the corresponding heat pipe, and two lateral portions contacting each of the outer sidewalls of the heat sink.

7. The LED lamp of claim 6, wherein each of the LED modules has two lateral portions symmetrically located at two sides of the corresponding heat pipe, and the LED of each of the LED modules being located above the corresponding heat pipe.

8. The LED lamp of claim 1, wherein the inner wall of the heat sink has a cylindrical configuration with the fins of the heat sink spaced from each other a distance.

9. The LED lamp of claim 8, wherein each of the fins has inward decreasing thickness to define a plurality of spaced gaps between the fins, the gaps adapted for providing passages of airflow therethrough, the gaps each having a same width.

10. The LED lamp of claim 8, wherein inner side edges of the fins corporate to defined a through hole in a central area along the axis of the heat sink.

11. A heat dissipation device for dissipating heat from LED modules, comprising:

a hollow heat sink comprising a plurality of outer sidewalls adapted for mounting the LED modules thereon, and a cylindrical inner wall having a plurality of fins extending inwardly therefrom, each of the outer sidewalls defining a groove therein; and a plurality of heat pipes being accommodated in corresponding grooves of the heat sink, adapted for contacting the LED modules directly and transferring heat generated by the LED modules to the heat sink evenly.

12. The heat dissipation device of claim 11, wherein the grooves of the heat sink are located parallel to each other from a bottom to a top of the heat sink.

13. The heat dissipation device of claim 11, wherein each of the heat pipes has a planar surface being located in a common plane with a corresponding outer sidewall of the heat sink, the planar surface being adapted for directly contacting with a corresponding LED module.

14. The heat dissipation device of claim 11, wherein a plurality of evenly spaced gaps are defined between the fins by decreasing a thickness of each of the fins inwardly.

15. The heat dissipation device of claim 14, wherein a circular through hole is enclosed by inner side edges of the fins in a central area of the heat sink, and the through hole communicates with the gaps between the fins of the heat sink.

16. The heat dissipation device of claim 11, wherein each of the fins has a height identical to that of the heat sink.

17. The LED lamp of claim 1, wherein each of the heat pipes contacts with multiple LED modules.

* * * * *